US006926269B2

(12) United States Patent
Ishikuro

(10) Patent No.: US 6,926,269 B2
(45) Date of Patent: Aug. 9, 2005

(54) PAPER CASSETTE AND PAPER FEEDING APPARATUS

(75) Inventor: Takemasa Ishikuro, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/662,346

(22) Filed: Sep. 16, 2003

(65) Prior Publication Data

US 2004/0070138 A1 Apr. 15, 2004

(30) Foreign Application Priority Data

Sep. 17, 2002 (JP) ..... 2002-269768

(51) Int. Cl.[7] ..... B65H 1/00
(52) U.S. Cl. ..... 271/171
(58) Field of Search ..... 271/171

(56) References Cited

U.S. PATENT DOCUMENTS 4,343,461 A * 8/1982 Tomimori et al. ..... 271/22
4,780,740 A * 10/1988 Fukae ..... 399/86
6,267,371 B1 * 7/2001 Jessop ..... 271/171
6,793,215 B2 * 9/2004 Salomon ..... 271/171

FOREIGN PATENT DOCUMENTS

| | | |
|---|---|---|
| GB | 2146626 | * 4/1985 |
| JP | 5278869 | * 10/1993 |
| JP | 08-324804 | 12/1996 |

* cited by examiner

*Primary Examiner*—David H. Bollinger
(74) *Attorney, Agent, or Firm*—Rabin & Berdo, P.C.

(57) ABSTRACT

A paper cassette holds a stack of print medium therein. A guide member includes first and second members. A medium-supporting plate supports the stack of the paper placed thereon. When the guide member is moved to a predetermined position, the first member abuts the end of the stack of print medium and the second member slides under the edges of the paper placed on the medium-supporting plate. The second member has a tapered forward end portion that allows the second member to smoothly slide under the bottom of the stack of print medium. The guide member is guided in a groove to move to and from the stack of print medium. The second member has a flat portion and the tapered forward end portion extends further away from the flat portion than the bottom of the stack of print medium.

22 Claims, 21 Drawing Sheets

CONVENTIONAL ART

PAPER CASSETTE AND PAPER FEEDING APPARATUS

FIELD OF THE INVENTION

The present invention relates generally to a medium cassette and a medium feeding apparatus.

DESCRIPTION OF THE RELATED ART

Image-forming apparatus such as an ink jet printer, an electrophotographic printer, a facsimile machine, and a copying machine are equipped with a paper-feeding apparatus. Japanese Patent Laid Open No. 8-324804 discloses one such paper-feeding apparatus. The paper-feeding apparatus includes a paper cassette having tray sections in which stacks of print paper of various sizes are accommodated. The tray section has guides that define the width or depth of a paper-accommodating space in the tray section to prevent the paper from becoming skewed and determine a region on the print paper in which printing should be initiated. Depending on whether the guides engage the side or edge of the print paper, the guides are generally called a side guide or a tail guide.

There are two types of tray sections: step-wise adjustable type and free adjustable type. For the step-wise adjustable type, side guides or a tail guide is secured by screwing or fitting into the body of the tray section to adjustably set the position of the stack of print paper P. For the free adjustable type such as a universal cassette, the side guides or the tail guide is moved freely to adjustably set the position of the stack.

FIG. 31 is a perspective view of a conventional paper-feeding cassette.

FIG. 32 is a perspective view of the conventional paper cassette when it is loaded with a stack of print paper.

FIG. 33 is a side view as seen in a direction shown by arrow K of FIG. 32.

Referring to FIG. 31, a cassette 101 has a tail guide 102 that is slidably movable back and forth behind the stack of print paper P to adjust the depth of the paper-accommodating space. Referring to FIG. 33, after the stack of print paper P has been placed in the cassette 101, the tail guide 102 is moved in a plane below the bottom of the stack of the print paper P until the tail guide 102 abuts the print paper.

The cassette 101 has a plurality of grooves 101*a*. When a locking member of the tail guide 102, not shown, engages the grooves 101*a*, movement of the tail guide 102 is limited to complete the positioning of the stack of print paper.

When the tail guide 102 is being moved, the tail guide 102 may scratch and damage the bottom few pages of the stack of print paper.

The tail guide 102 is commonly a rectangular solid as shown in FIGS. 31 and 32. The bottom pages of the stack of print paper may have become wavy due to moisture absorption and/or improper placement of the stack of paper. As a result, the bottom pages may project into the space 101*c* in which the horizontal portion of the tail guide 102*a* moves back and forth. Thus, when the tail guide 102 moves forward, the wavy bottom of the stack of print paper becomes an obstacle to the movement of the tail guide 102, so that the tail guide 102 will damage the print paper P or cause the print paper P to become wrinkled or crumpled.

The locking member of the tail guide 102 engages the groove 101*a*, which limits the stroke of the tail guide 102.

The cassette 101 has a sheet-supporting plate 103 positioned forward of the stroke of the tail guide 102, the sheet supporting plate 103 pushing up the forward portion of the stack of the print paper P. The sheet-supporting plate 103 may be formed of plastics but is usually made of a metal plate. This is because the sheet-supporting plate 103 is required to urge the print paper P against a feed roller, not shown, from bottom while at the same time supporting the heavy stack of print paper P. The sheet-supporting plate 103 is designed to pivot about an axis sufficiently away from the feed roller. This is to ensure only a small difference in the attack angle of the sheet supporting plate 103 with the feed roller between when a large number of pages are on the sheet supporting plate 103 and when a small number of pages are on the sheet supporting plate 103. Thus, the sheet-supporting plate 103 is made large.

If the sheet-supporting plate 103 is made larger than A5 size paper or A6 size paper, the A5 size paper or A6 size paper will not project further rearward than the rear end of the sheet-supporting plate 103. Therefore, the tail guide 102 will not engage the rear end of the stack of such small size paper, so that the tail guide 102 does not perform its function. Of course, this drawback may be overcome by providing an exclusive guide member instead of the tail guide 102. Alternatively, the sheet-supporting plate 103 may be designed to have a width and a depth as large as the entire floor width of the cassette 101 so that the tail guide can move over a longer stroke. This will increase the manufacturing costs of the apparatus. A large width of the tail guide 102 requires a large aperture through which the tail guide 102 moves back and forth. This will reduce mechanical strength of the cassette 101.

SUMMARY OF THE INVENTION

The present invention was made in view of the aforementioned problems of the conventional image forming apparatus.

An object of the invention is to provide a paper cassette and a paper feeding apparatus that is inexpensive, mechanically strong, and capable of feeding print paper in a stable manner without damaging the print paper.

A medium cassette that holds a stack of print medium (e.g., print paper) therein includes a medium guide member and a supporting member. The medium guide member includes a first member and a second member. The second member has a tapered forward end portion. The supporting member has a groove formed therein by which the medium guide member is guided to move to and from the stack of print medium. When the medium guide member is moved in a direction toward the stack of the print medium in the groove to a predetermined position, the first member abuts an end of the stack of print medium and the tapered forward end portion slides under the stack of print medium.

The tapered forward end portion extends further downward below a bottom of the stack of print medium.

The second member has an edge that edge extends from a middle portion of the second member leftward and rightward with respect to the direction. The edge becomes further away from the stack of print medium than the middle portion with increasing distance from the middle portion.

The edge extends from the middle portion to describe either a curved line or a straight line.

The paper cassette includes a medium-supporting member on which the stack of print medium is placed, wherein the medium guide member can be mounted on the medium-supporting member.

The medium guide member further includes a projection that extends through the groove. The slide member projection includes second projections that project substantially leftward and rightward with respect to the direction so that the supporting member is sandwiched between the second member and the second projections.

The second projections includes a first set of second projections that extends over a first distance and a second set of second projections that extends over a second distance.

Each of the second projections has a plurality of stepped portions. The supporting member can be held in a sandwiched relation between the second member and a corresponding one of the plurality of stepped portions.

The medium guide member includes a locking member and the medium-supporting member has a recess formed therein by a drawing operation. When the locking member is received in the recess, the medium guide member is locked at a predetermined position.

The medium-supporting member has an opening beside the recess.

A paper feeding apparatus incorporates the aforementioned medium cassette.

A medium cassette that holds a stack of print medium (e.g., print paper) therein includes a supporting member, a medium guide member, and a medium-supporting member.

The supporting member has a groove formed therein. The medium guide member includes a first member and a second member that slides under the stack of print medium. The medium guide member is detachably mounted to the supporting member and guided in the groove to and from the stack of print medium. The stack of print medium is placed on the medium-supporting member that pushes up the print medium. The medium-supporting member has an opening formed therein through which the medium guide member can be mounted.

A paper feeding apparatus incorporates the aforementioned paper cassette.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

Figure 1:
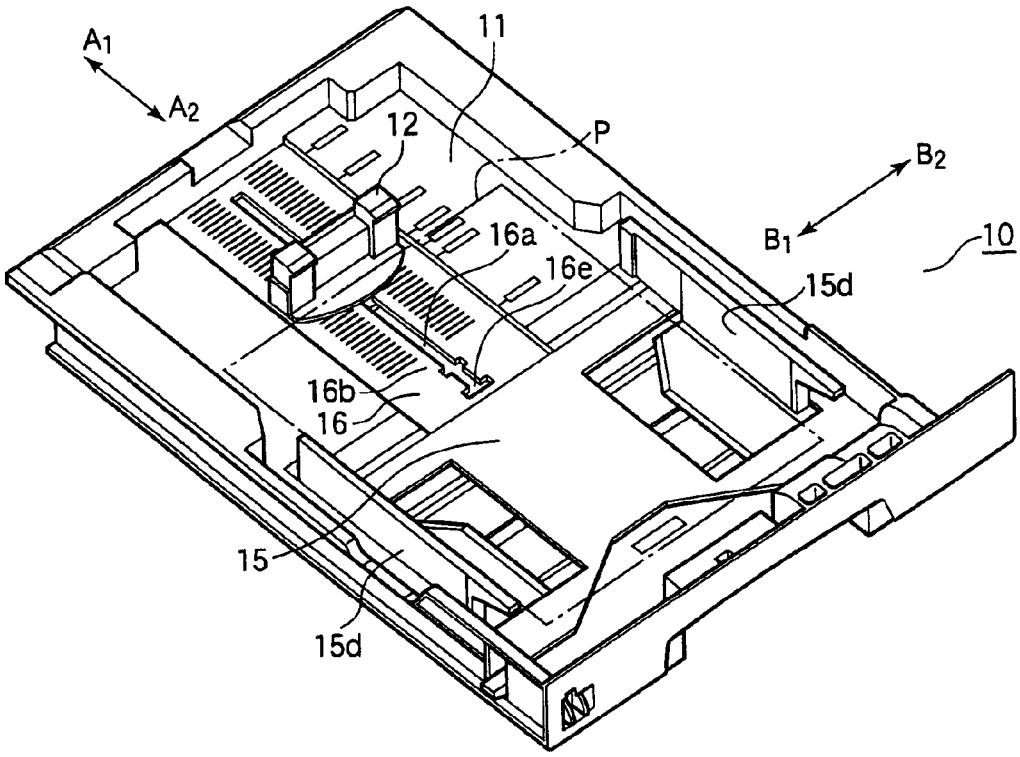
FIG. 1 is a perspective view of a paper cassette according to a first embodiment.

FIG. 1 is a perspective view of a paper cassette according to a first embodiment.

Figure 2:
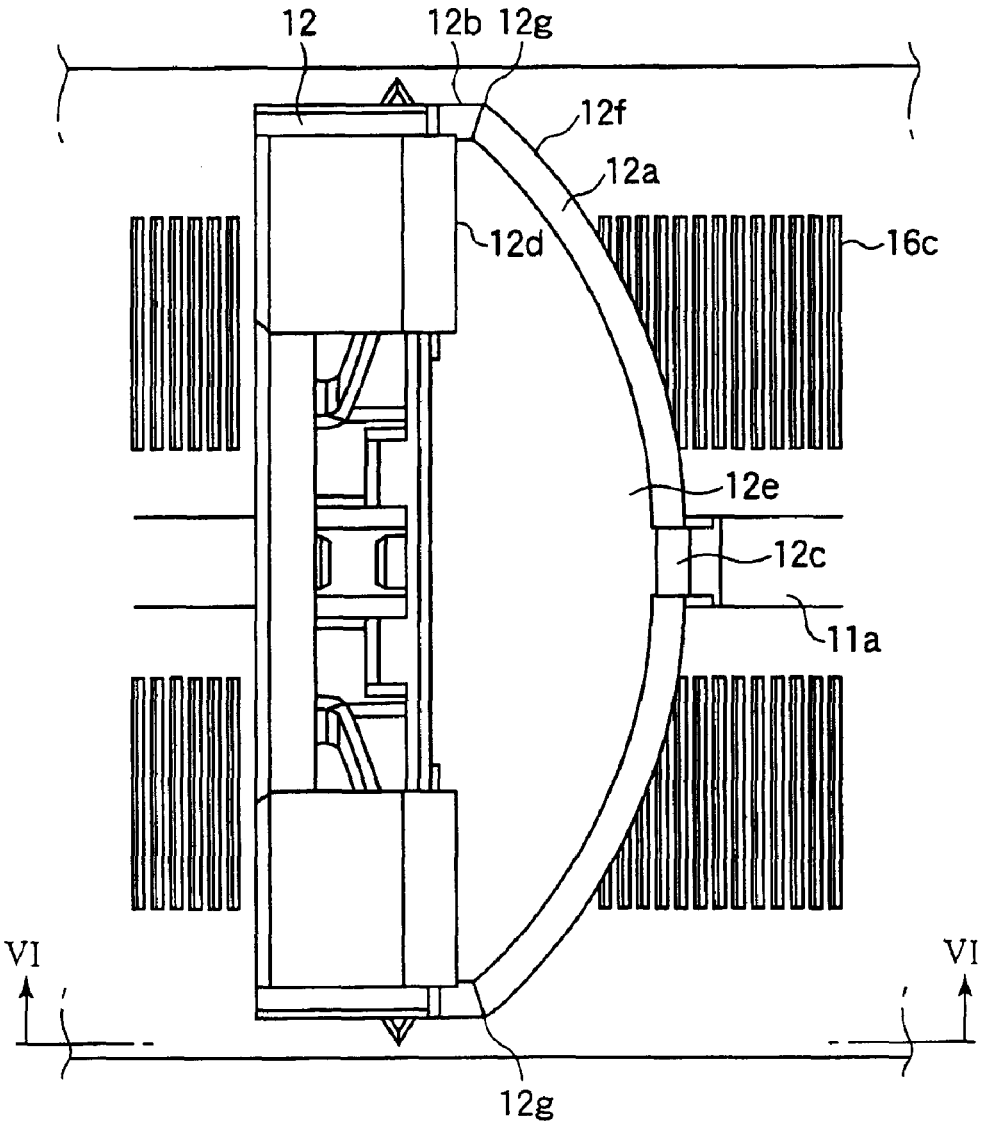
FIG. 2 is a top view of the first embodiment according to the invention.

FIG. 2 is a top view of the first embodiment according to the invention.

Referring to FIG. 1, a cassette 10 has a tail guide 12 that is slidably movable back and forth in directions shown by arrow A1 and A2 behind a stack of print paper P to adjust the depth of a space in which the print paper P is accommodated.

After the stack of print paper P has been placed in the cassette 10, the tail guide 12 is moved in a plane below the bottom of the stack of the print paper P until the tail guide 12 abuts the print paper P. The cassette 10 has side guides 15*d* and 15*d* that are adjustable in directions shown by arrow B1 and B2 toward and away from the sides of the stack of print paper P to laterally guide the print paper. The cassette 10 also has a sheet-supporting plate 15 positioned forward of the stroke of the tail guide 12, the sheet-supporting plate 15 being pivotal about an axis 15*e* (FIG. 25) to push up a forward end portion of the stack of the print paper.

Referring to FIG. 2, the tail guide 12 has an arcuate forward end portion 12*a* with a forwardly tapered thickness. The arcuate forward end portion 12*a* has an edge 12*f* that extends leftward and rightward from a middle portion 12*c* in such a way that the edge 12*f* becomes further away from the stack of paper than the middle portion 12*c* with increasing distance from the middle portion 12*c*. Thus, the leftmost and rightmost ends of the arcuate forward end portion 12*a* are most away from the stack of the print paper P. The tail guide 12 also has a left straight side 12*b* and a right straight side 12*b* that extend in parallel to each other. The left and right sides 12*b* join with the edge 12*f* at edges 12*g*.

The cassette 10 is capable of holding a stack of paper P, and can be incorporated in image-forming apparatus such as ink jet printers, electrophotographic printers, facsimile machines, and copiers.

Referring back to FIG. 1, a guide member 16 has an opening 16*e* through which the tail guide 12 can be dismounted from the floor member 11.

Figure 3:
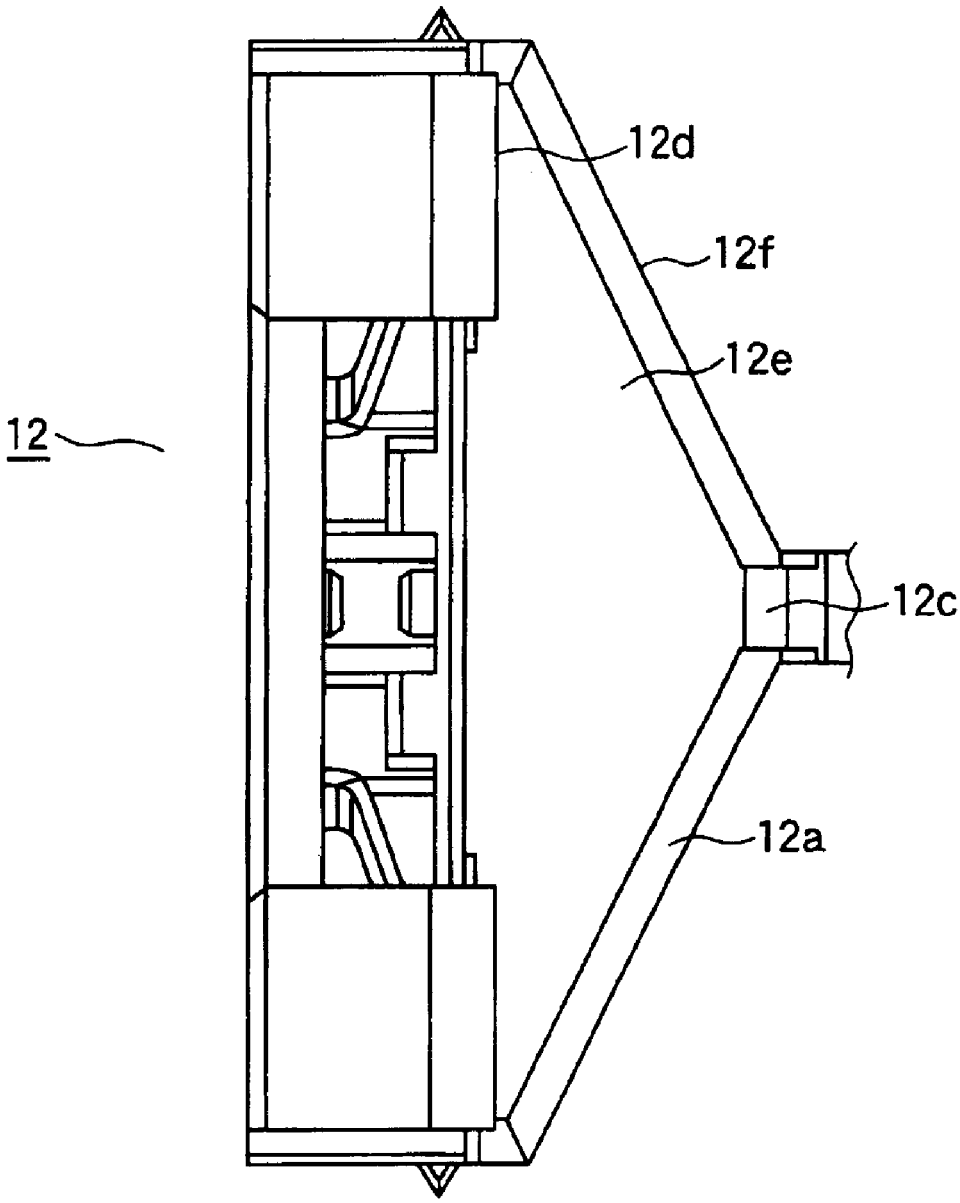
FIG. 3 illustrates a modification to the edge of the tail guide.

FIG. 3 illustrates a modification to the edge of the tail guide 12.

Figure 4:
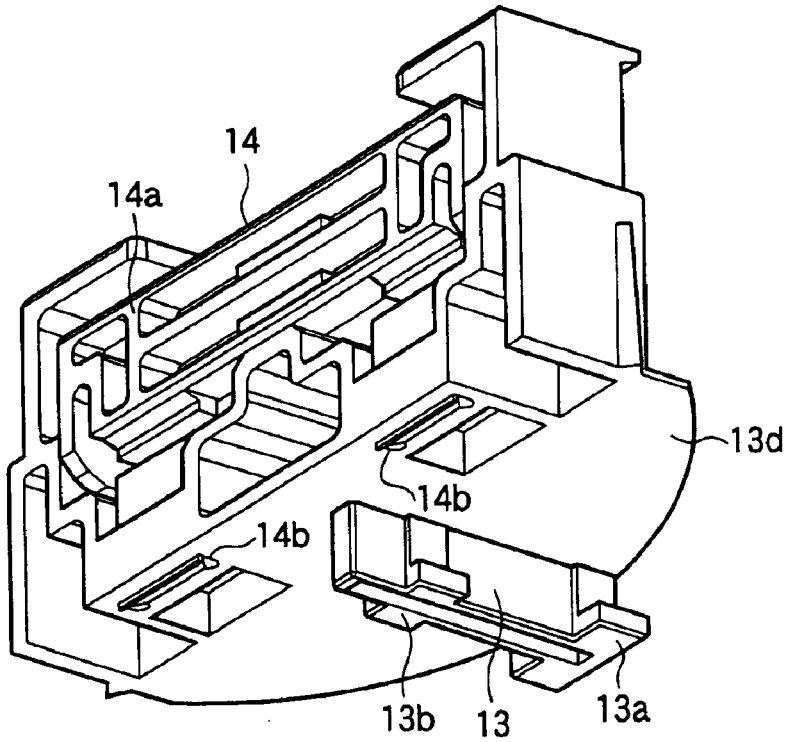
FIG. 4 is a perspective view of the tail guide of FIG. 1 as seen obliquely upward.

FIG. 4 is a perspective view of the tail guide 12 as seen obliquely upward.

Figure 5:
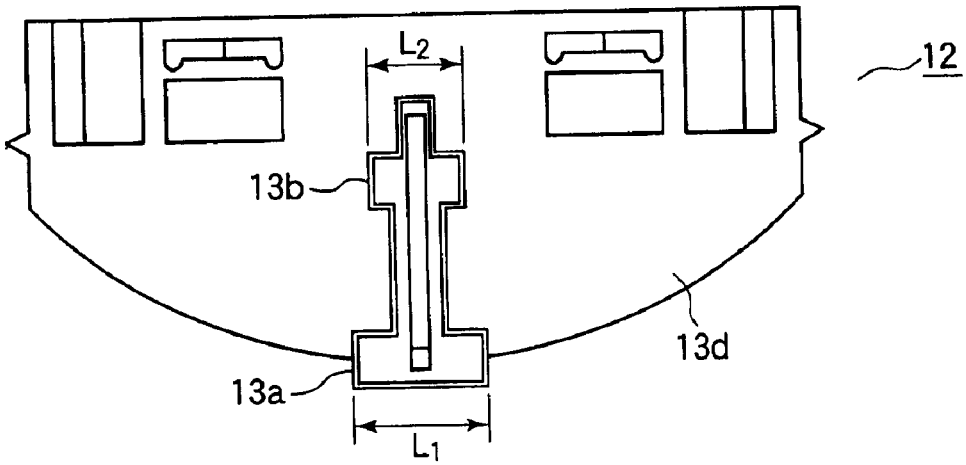
FIG. 5 is a bottom view of the tail guide of FIG. 1.

FIG. 5 is a bottom view of the tail guide 12.

Referring to FIGS. 4 and 5, the tail guide 12 includes a slide 13 at its bottom that slides in a groove 11*a* formed in the floor member 11. The slide 13 has projections 13*a* and 13*b* that project laterally leftward and rightward. When the tail guide 12 is mounted to the cassette 10, the projections 13*a* and 13*b* are inserted into the opening 16*e* and then moved away from the opening 16*e* along the groove 16*a*. Guide edge portions 16*b* define the perimeters of the groove 16*a* and are loosely sandwiched between the back surface 13*d* of the tail guide 12 and the projections 13*a* and 13*b* of the slide 13. Thus, the tail guide 12 is movable in the groove 16*a* along the guide 16*b*.

Figure 6:
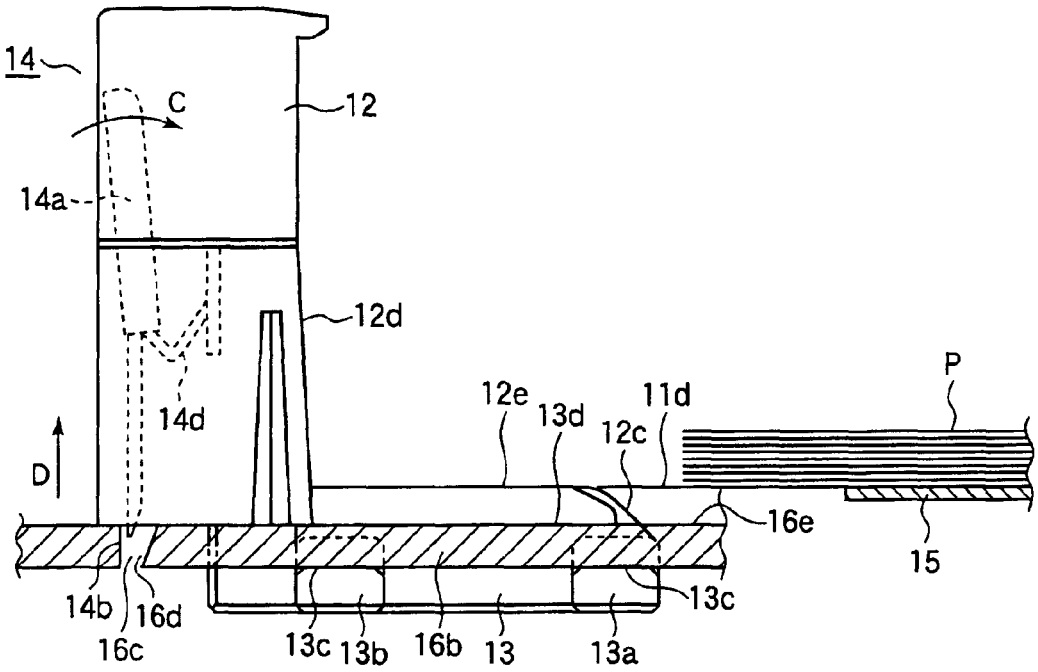
FIG. 6 is a detailed side view of the tail guide taken along lines VI—VI of FIG. 2.

FIG. 6 is a detailed side view of the tail guide taken along lines VI—VI of FIG. 2.

Referring to FIG. 6, the tail guide 12 has a locking member 14 with a handle 14*a* and a locking tongue 14*b*. When the locking tongue 14*b* engages a locking hole 16*c* formed in the guide member 16, the tail guide 12 is in a locked state. The locking member 14 has a resilient portion 14*d* that urges the locking member 14 in the opposite direction to arrow C. When the user operates the handle 14*a* in a direction shown by arrow C, the locking tongues 14*b* (only one of two locking tongues 14*b* is shown) move in a direction shown by arrow D to move out of locking engagement with the openings 16*c*. Each of the locking tongues 14*b* has a tapered free end portion 14*c* that facilitates dismounting of the tail guide 12 from the guide member 16. The guide member 16 has inclined surfaces 16*d* formed thereon, the inclined surfaces 11*g* forming the perimeter of the openings 16*c*. The inclined surface 16*d* facilitates smooth insertion of the locking tongues 14*b* into the opening 11*c*.

The middle portion 12*c* of the tail guide 12 is tapered and extends further downward than an upper surface 16*e* of the guide member 16. This is equivalent to saying that the middle portion 12*c* extends further downward than an upper surface of the sheet-supporting plate 15. Thus, the middle portion 12*c* can smoothly slide under the edge of the print paper P placed on the floor surface 11*d* to slightly push up the stack of the paper. Thus, the edge of the stack of the paper P slides upward on the tapered surface of the forward end portion 12*a*. The edge 12*f* of the forward end portion 12*a* is preferably curved without corners as shown in FIG. 2, but may be straight as shown in FIG. 3. Still alternatively, the edge 12*f* may have some corners provided that the corners make obtuse angles not to catch the edges of the sheets of print paper P.

The operation of the tail guide 12 for positioning the stack of print paper P will be described.

First, the user places a stack of print paper P in the cassette 10 and adjusts the position of the tail guide 12 in accordance with the size of print paper P. At this moment, the trailing edge of the stack of the print paper P slides upward on the tapered surface of the forward end portion 12*a*. It is to be noted that the edge 12*f*, which moves into direct contact engagement with the trailing edge of the print paper P, describes a smooth arcuate curve. Thus, the edge 12*f* will not bite the trailing edges of few bottom pages of print paper P but guide a flat portion 12*e* of the tail guide 12 to slide under the trailing edge of the print paper P. The smooth sliding motion of the forward end portion 12*a* prevents the print paper P from becoming wrinkled, crumpled, and/or damaged.

While pushing the trailing end of the stack of print paper P, a vertical wall 12*d* of the tail guide 12 is moved forward until the vertical wall 12*d* reaches a predetermined position that corresponds to the size of the print paper P. When the locking tongue 14*b* moves into engagement with one of the openings 16*c*, the tail guide 12 is locked so that the stack of print paper P is placed in position.

The arcuate forward end portion 12*a* should extend as far as the width of the print paper P, so that the wavy trailing edges of few bottom pages of the print paper P will not enter gaps or clearances between the tail guide and inner walls of the cassette 10.

Second Embodiment

In the first embodiment, the cassette 10 has a plurality of openings 16*c* formed therein for the purpose of positioning the tail guide 12 at an appropriate position in accordance with the size of print paper P. As described in "DESCRIPTION OF THE RELATED ART", if the sheet-supporting plate 15 is made too large, the tail guide 12 fails to properly guide a stack of small size print paper such as A5 size and A5 size. For solving the problem, in a second embodiment, the tail guide 12 is also attachable to the sheet-supporting plate 15 so that the tail guide 12 can guide small size print paper as well.

Figure 7:
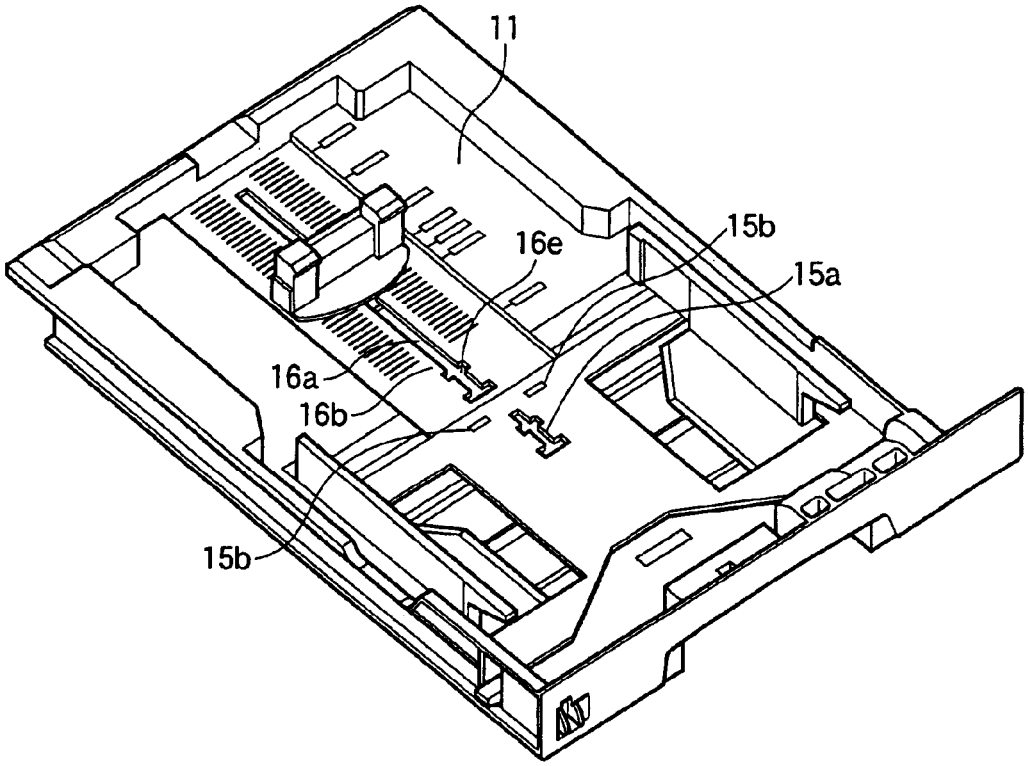
FIG. 7 is a perspective view of a cassette according to a second embodiment.

FIG. 7 is a perspective view of a cassette according to the second embodiment.

Referring to FIG. 7, a floor member 11 has an opening 11*e* continuous to the forward portion of the groove 16*a* through which the tail guide 12 can be dismounted from the guide member 16. The sheet-supporting plate 15 has openings 15*b* and 15*b* that lie on the same line as the openings 16*c* and an opening 15*a* that lies on the same line as the groove 16*a*. The small opening 15*a* allows the tail guide 12 to be mounted on the sheet-supporting plate 15 when the tail guide 12 guides small size paper such as A5 size and A6 size. The openings 15*b* and 15*b* are used for positioning and locking the tail guide 12.

Figure 8:
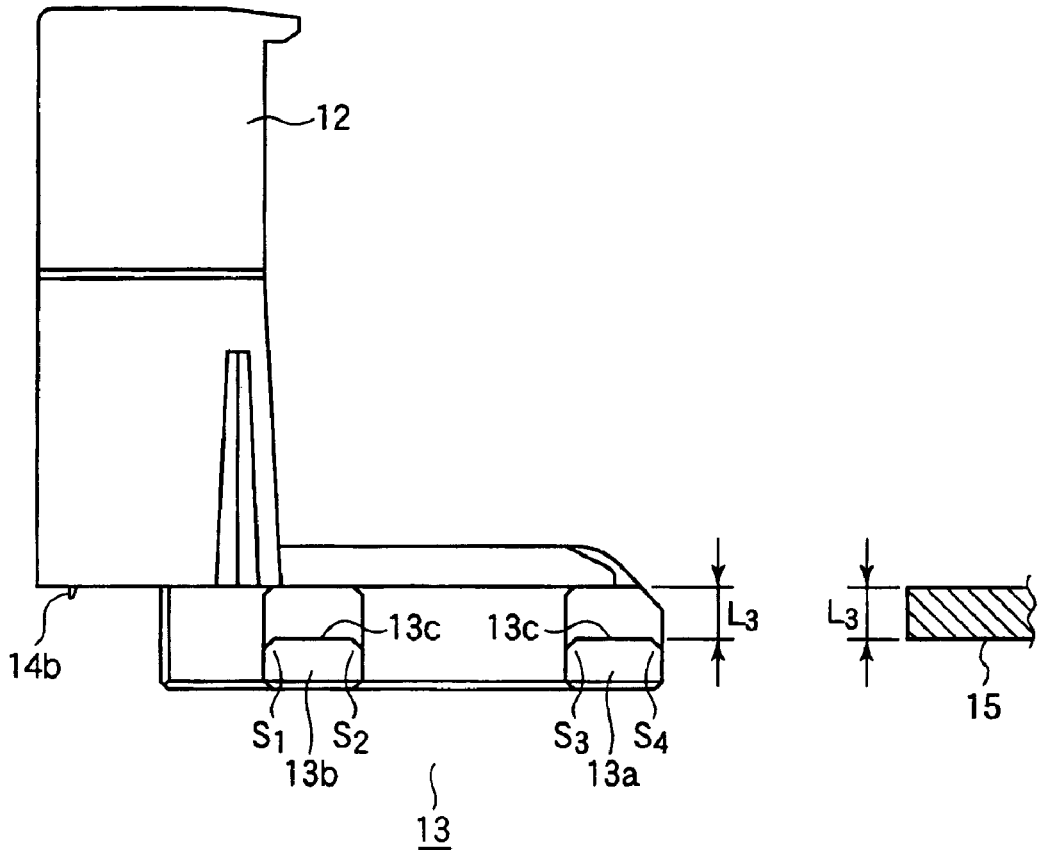
FIG. 8 is a side view of the tail guide.

FIG. 8 is a side view of the tail guide.

Figure 12:
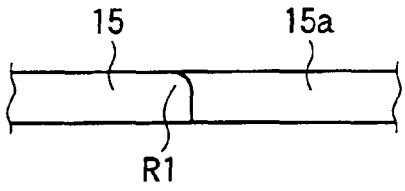
FIG. 12 is an enlarged side view of a rounded portion R1 of FIG. 11.

Referring to FIG. 12, the slide 13 has projections 13*a* and 13*b* that project laterally leftward and rightward. The projections 13*a* and 13*b* have rounded upper corner portions as depicted by S1–S4 in FIG. 12.

Figure 13:
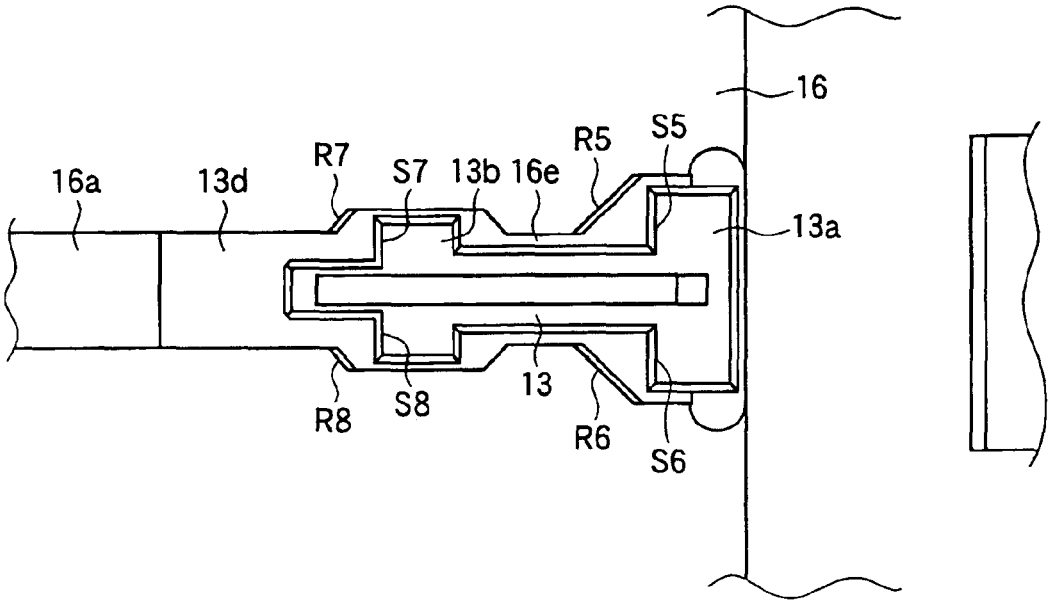
FIGS. 13 and 14 are bottom views of the groove.

FIG. 13 is a bottom view of the tail guide.

The projection 13*a* has a dimension L1 and the projection 13*b* has a dimension L2, L1 being larger than L2. The projections 13*a* and 13*b* are inserted through the opening 16*e* in such a way that the guide edges 16*b* forming the perimeters of the groove 16*a* are loosely sandwiched between the back surface 13*d* of the tail guide 12 and the projections 13*a* and 13*b*.

The tail guide 12 can be dismounted from the guide member 16 through the opening 16*e*. Also, the tail guide 12 can be mounted to the sheet-supporting plate 15 by inserting the projections 13*a* and 13*b* into the opening 15*a* such that the guide edges 16*b* are loosely sandwiched between the back surface 13*d* and the projections 13*a* and 13*b*. The tail guide can be dismounted by pulling out the projections 13*a* and 13*b* through the opening 15*a*.

The operation of the tail guide 12 for positioning the paper will be described.

Figure 9:
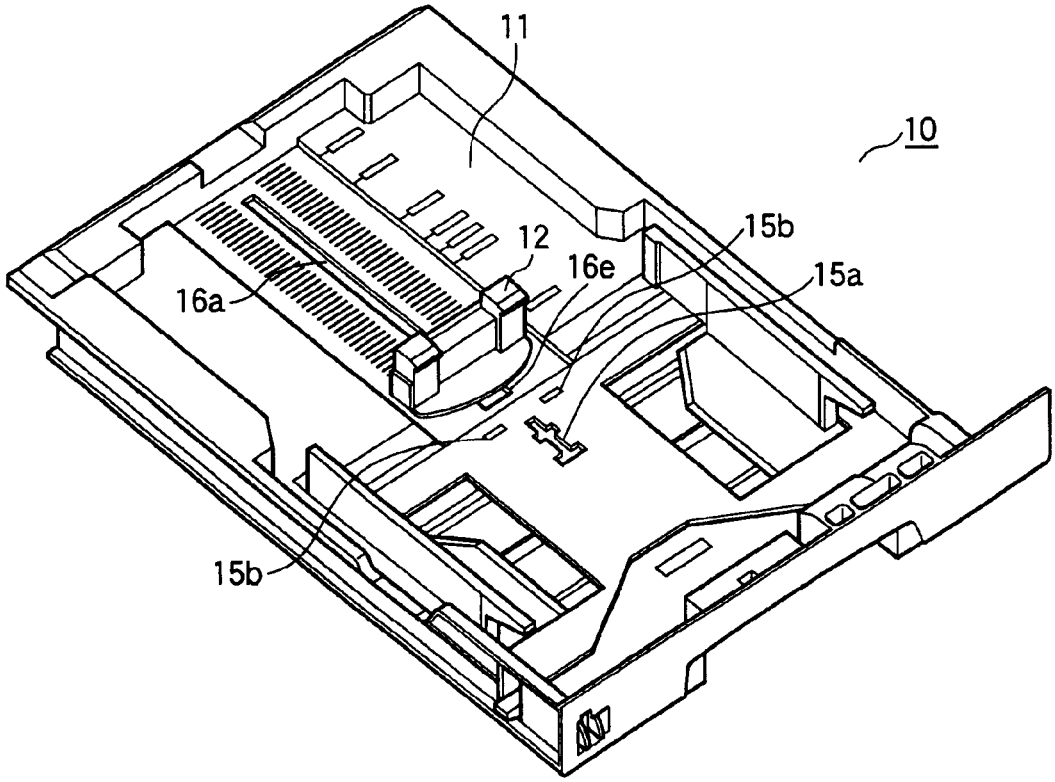
FIG. 9 is a perspective view of the cassette according to the second embodiment when the tail guide is at the opening.

FIG. 9 is a perspective view of the cassette according to the second embodiment when the tail guide is at the opening 16*e*.

Figure 10:
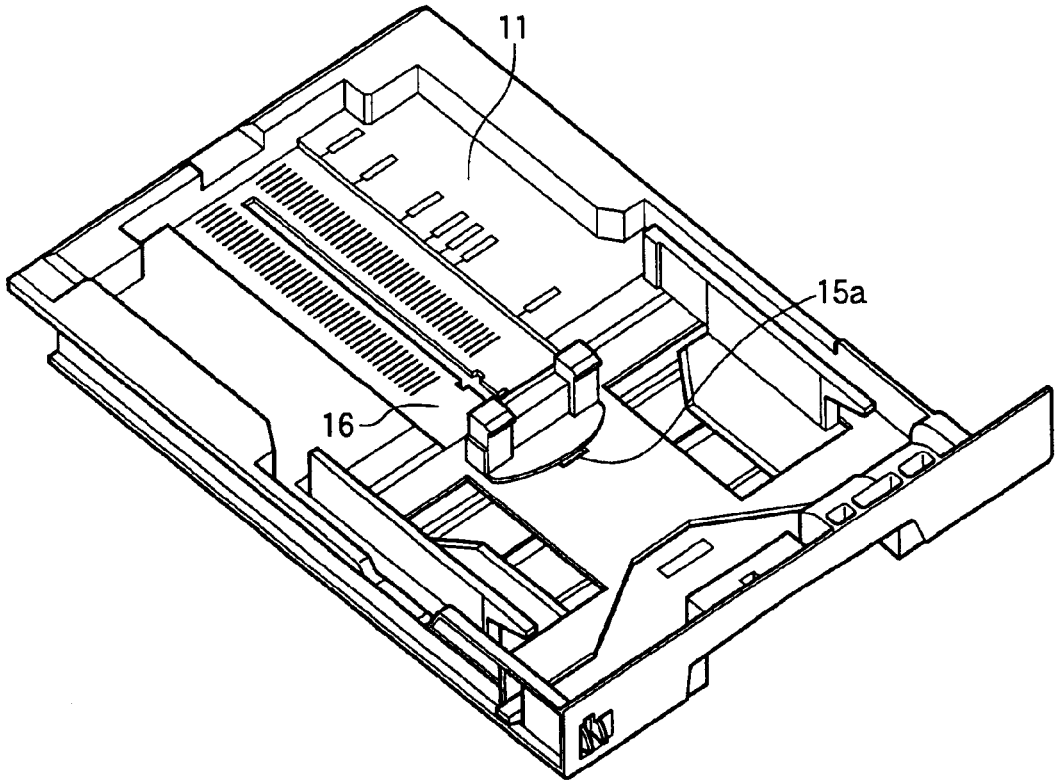
FIG. 10 is a perspective view of the cassette according to the second embodiment when the tail guide is at the opening.

FIG. 10 is a perspective view of the cassette according to the second embodiment when the tail guide is at the opening 15*a*.

Figure 11:
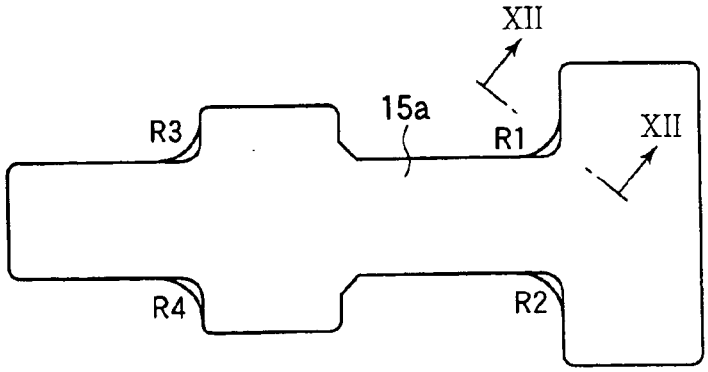
FIG. 11 is a bottom view of the opening.

FIG. 11 is a bottom view of the opening 15*a*.

FIG. 12 is an enlarged side view of a rounded portion R1 of FIG. 11.

As shown in FIG. 9, the user causes the tail guide 12 to slide along the groove 16*a* to the opening 16*e*. The projections 13*a* and 13*b* are then pulled out of the opening 16*e*. Then, the user mounts the tail guide 12 on the sheet-supporting plate 15 by inserting the projections 13*a* and 13*b* into the opening 15*a* as shown in FIG. 10. Then, the user moves the tail guide somewhat rearward so as to lock the locking tongues 14*b* into the openings 15*b* and 15*b*.

The perimeter of the opening 15*a* has rounded corners as depicted at R1–R4 in FIG. 11. The edge portions of the rounded corners are also chamfered as depicted at S1–S4 in FIG. 8. The aforementioned rounded and chamfered corners cooperate to place projections 13*a* and 13*b* in position below the opening 15*a*, so that the tail guide 12 can move smoothly back and forth in a direction in which the opening 15*a* generally extends.

When the paper cassette 10 holds print paper P having a relatively larger size than A5 size, the user dismounts the locking tongues 14*b* from the openings 16*c* and causes the tail guide 12 to slide forward, thereby pulling out the tail guide 12 from the sheet-supporting plate 15. Then, the user inserts the projections 13*a* and 13*b* into the openings 16*e* formed in the guide member 16 so that the tail guide 12 is again mounted to the groove 16*e* so that the tail guide 12 is again mounted through the groove 16*a*.

Figure 14:
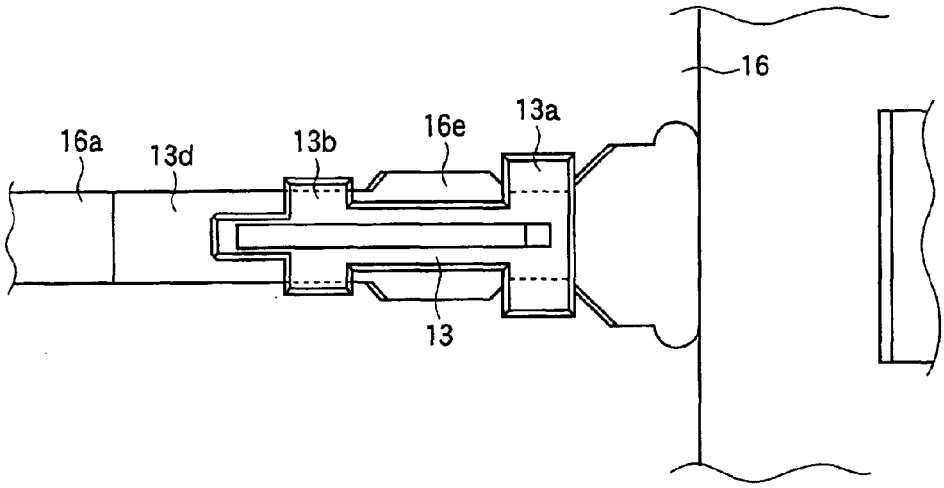

FIGS. 13 and 14 are bottom views of the groove 16*a*.

As shown in FIG. 13, the edges of the guide edges 16*b* that form the perimeters of the groove 11*a* are chamfered at portions R5–R8 and the projections 13*a* and 13*b* are chamfered at portions S5–S8. The chamfered portions R5–R8 and S5–S8 facilitate smooth insertion of the projections 13*a* and 13*b* into the opening 16*e* and cooperate with the chamfered portions S1–S4 in such a way that the projections 13*a* and 13*b* are guided rearward under the opening 16*e* as shown in FIG. 14.

The configuration of the second embodiment allows guiding of print paper P of small sizes such as A5 size and A6 size. Because the projection 13*a* has a length L1 while the projection 13*b* has a length L2, there is no chance of the tail guide 12 being attached to the guide member 16 in the wrong orientation.

The configuration of the second embodiment allows the sheet-supporting plate 15 to pivot about an axis away from the feed roller. For example, when a stack of A4 size paper is placed in the cassette, the attack angle of the sheet-supporting plate 15 can be in a relatively small range when the stack has a large number of pages and when the stack has a small number of pages. Thus, the configuration provides reliable feeding of print paper.

Further, the configuration eliminates the need for cutting away a portion of the sheet supporting plate 15 through which the tail guide 12 moves back and forth. This is advantageous since the mechanical strength of the sheet supporting plate 15 can be maintained.

Third Embodiment

In the second embodiment, the guide edge 16*b* or the sheet-supporting plate 15 of the cassette 11 is sandwiched between the underside 13*d* of the tail guide 12 and the projections 13*a* and 13*b*, thereby allowing the tail guide 12 to slide smoothly. This requires that the guide edge 16*b* and the sheet supporting plate 15 have the same thickness.

The guide edge 16*b* of the guide member 16 may be molded from, for example, plastics and the sheet supporting plate 15 may be formed of a metal plate. However, if the guide edge 16*b* is designed to have the same thickness as the sheet-supporting plate 15, the guide 11*b* cannot be rigid enough. If the molded guide edge 16*b* is to have the same thickness as ordinary molded components, the thickness of sheet-supporting plate 15 will have to be made too large. The sheet-supporting plate 15 is usually made by, for example, bending, drawing, and embossing a metal plate. Using too thick a metal plate results in an increase in manufacturing cost. In a third embodiment, a stepped portion 13*c* is formed, thereby limiting the upward and downward movement of the tail guide 12 even when the guide 16*b* and the sheet-supporting plate 15 differ in thickness.

Figure 15:
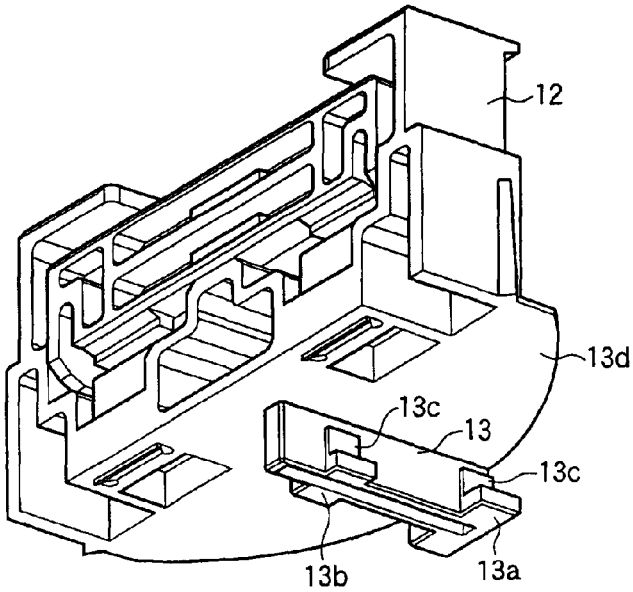
FIG. 15 is a perspective view of a tail guide according to a third embodiment.

FIG. 15 is a perspective view of a tail guide according to the third embodiment.

Figure 16:
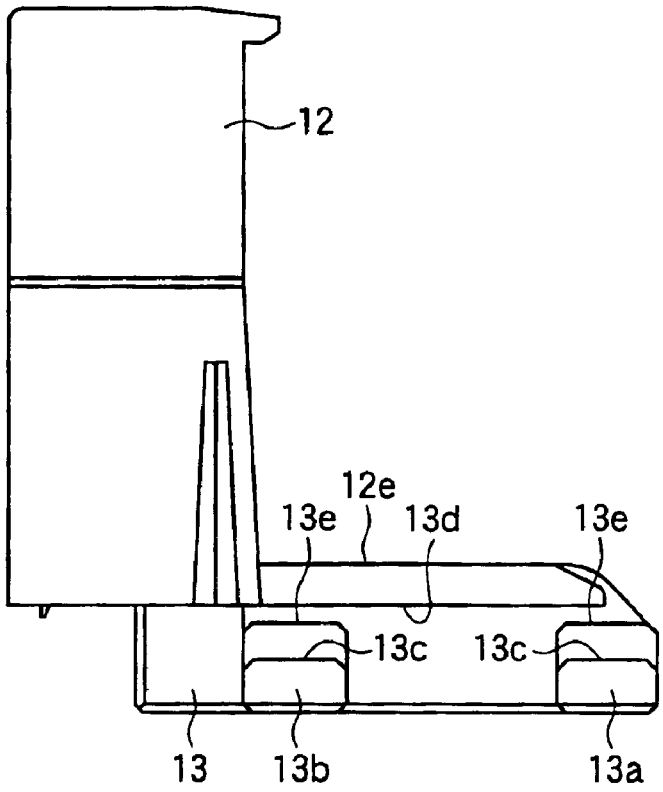
FIG. 16 is a side view of the tail guide.

FIG. 16 is a side view of the tail guide.

Figure 17:
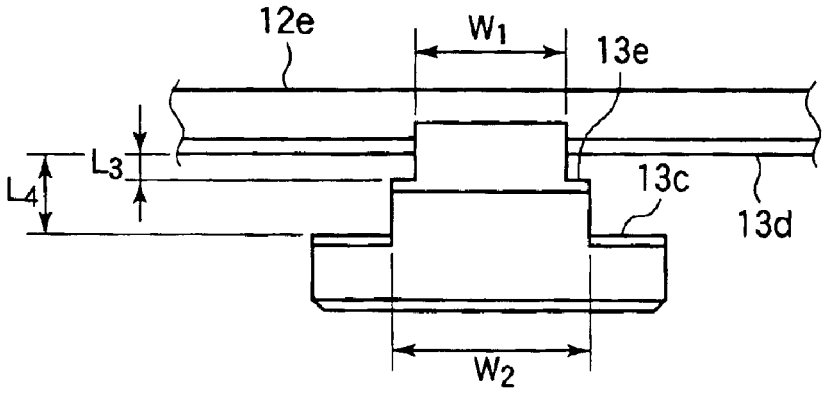
FIG. 17 illustrates the tail guide in detail.

FIG. 17 illustrates the tail guide in detail.

Referring to FIGS. 16 and 17, the projections 13*a* and 13*b* of the tail guide 12 are of a dual stepped-portion configuration. As shown in FIG. 16, the surfaces 13*c* of the projections 13*a* and 13*b* include an upper surface 13*c* and a lower surface 13*e*. As shown in FIG. 17, the distance L3 between the surface 13*d* of the tail guide 12 and the upper surface 13*e* is slightly greater than the thickness of the sheet supporting plate 15. The distance L4 between the surface 13*d* and the tail guide 12 and the lower surface 13*c* is slightly greater than the thickness of the guide edge 16*b*.

The width W1 of the stepped portion is slightly smaller than the width W2 of the opening 15*a* in the sheet supporting plate 15. The width W2 of the lower stepped portion is slightly smaller than the width of the groove 16*a* formed in the floor member 11.

The operation will be described in which the tail guide according to the third embodiment is used to place a stack of paper in position.

Figure 18:
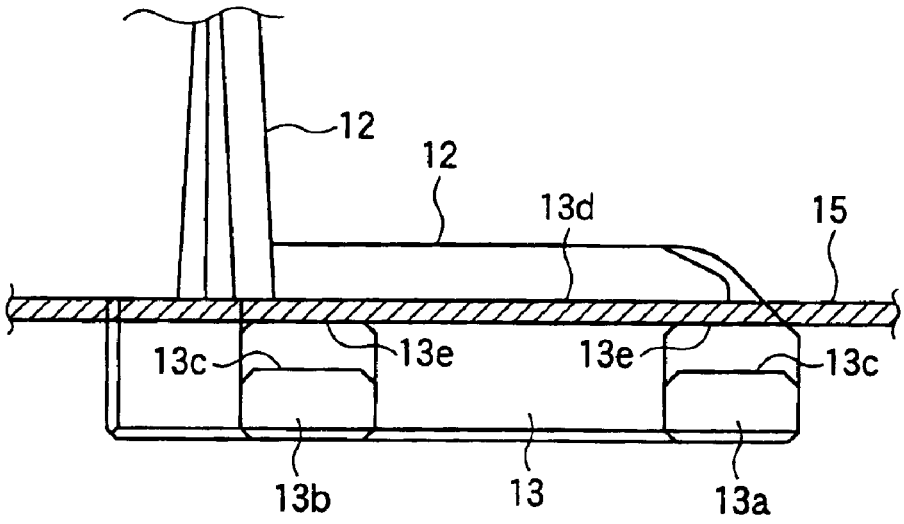
FIG. 18 is a side view of the tail guide when it is attached to the sheet-supporting plate according to the third embodiment.

FIG. 18 is a side view of the tail guide 12 when it is attached to the sheet-supporting plate 15 according to the third embodiment.

Figure 19:
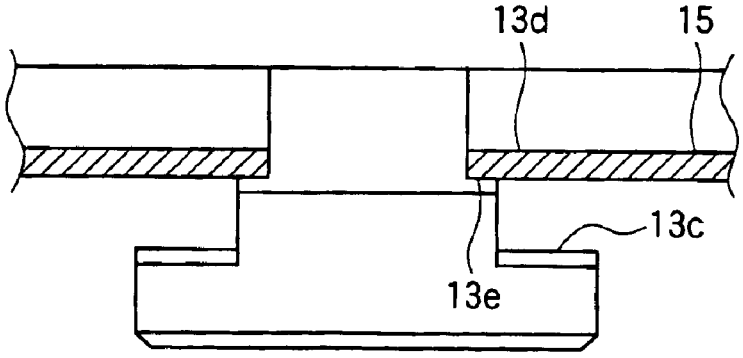
FIG. 19 is a front view of a lower portion of the tail guide when it is attached to the sheet-supporting plate.

FIG. 19 is a front view of a lower portion of the tail guide 12 when it is attached to the sheet-supporting plate 15.

Figure 20:
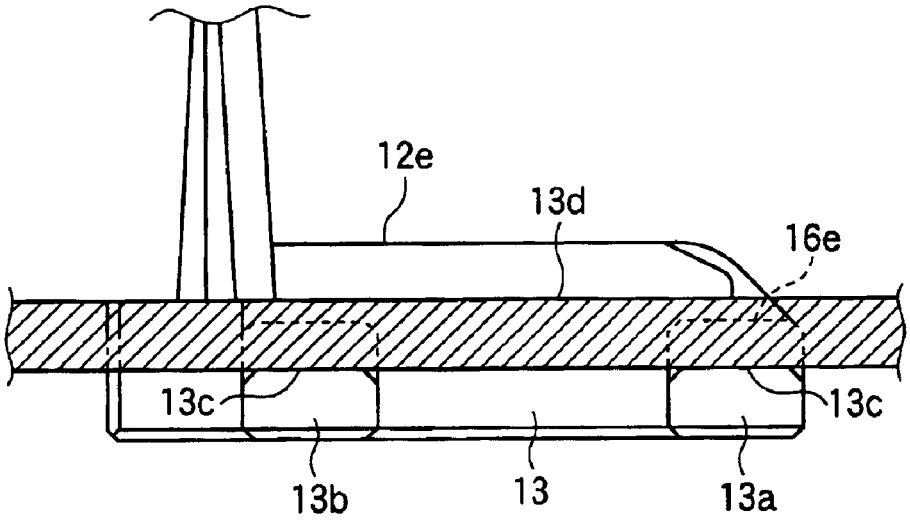
FIG. 20 is a side view of the tail guide when it is attached to the guide portion of the cassette.

FIG. 20 is a side view of the tail guide 12 when it is attached to the guide edge 16*b* of the cassette 10.

Figure 21:
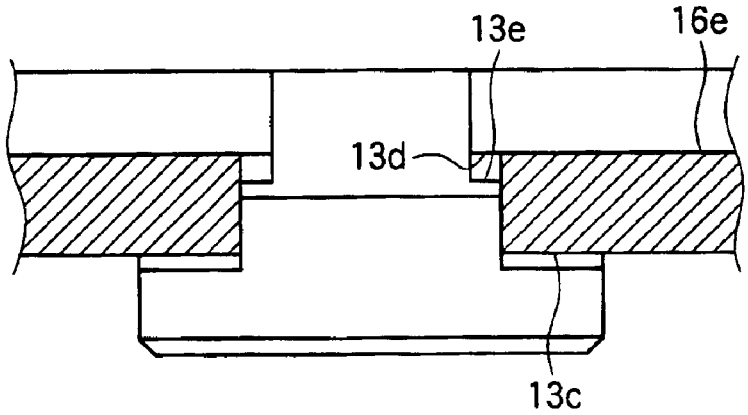
FIG. 21 is a front view of a lower portion of the tail guide when it is attached to the guide portion.

FIG. 21 is a front view of a lower portion of the tail guide 12 when it is attached to the guide edge 16*b*.

When the tail guide 12 is attached to the sheet-supporting plate 15 through the opening 15*a* for small size paper, the sheet-supporting plate 15 is sandwiched between the surface 13*d* of the tail guide 12 and the surfaces 13*c* of the projection 13*a* and 13*b*. Therefore, the upward and downward movements of the tail guide 12 are limited.

Subsequently, when the tail guide 12 is attached to the guide member 16 through the groove 11*a*, the floor member 11 is sandwiched between the surface 13*d* of the tail guide 12 and the surface 13*c*, thereby restricting the upward and downward movements of the tail guide 12.

In the third embodiment, a single tail guide 12 can be used to guide print paper of various sizes.

Fourth Embodiment

In the third embodiment the surfaces 13*c* and 13*c* are formed for positioning and locking the tail guide 12. The sheet-supporting plate 15 may lose its mechanical strength depending on the areas of the surfaces.

Figure 22:
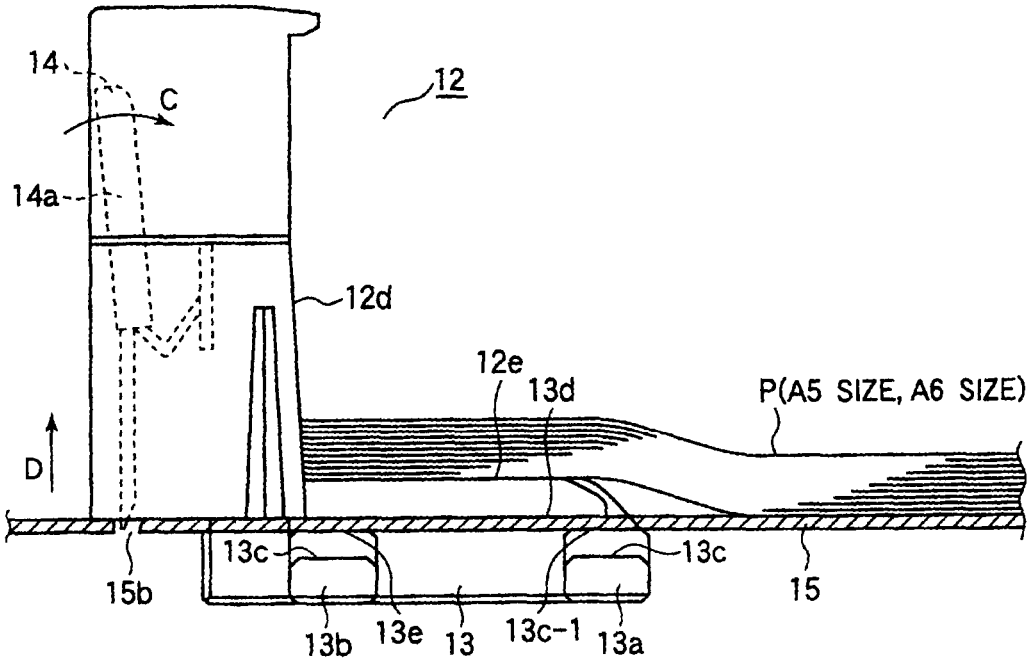
FIG. 22 is a side view of the tail guide according to a fourth embodiment when it is locked.

FIG. 22 is a side view of the tail guide 12 according to a fourth embodiment when it is locked.

Figure 23:
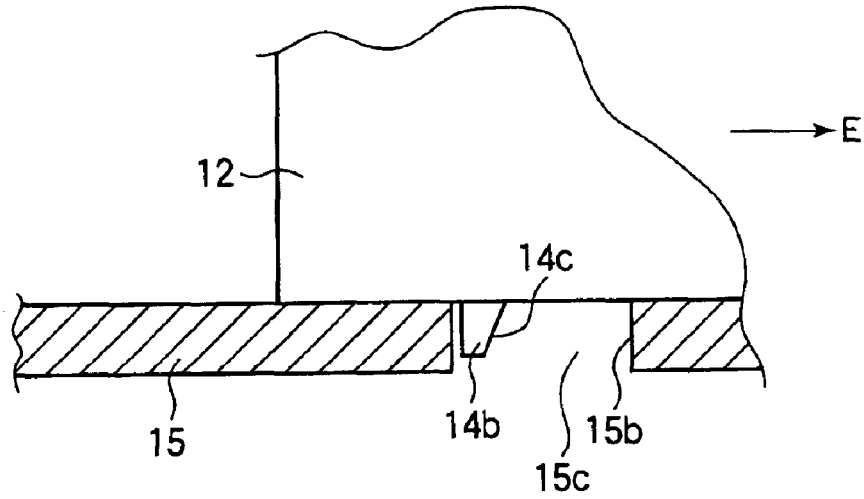
FIG. 23 is an enlarged fragmentary side view of the tail guide when it is locked.

FIG. 23 is an enlarged fragmentary side view of the tail guide 12 when it is locked.

Figure 24:
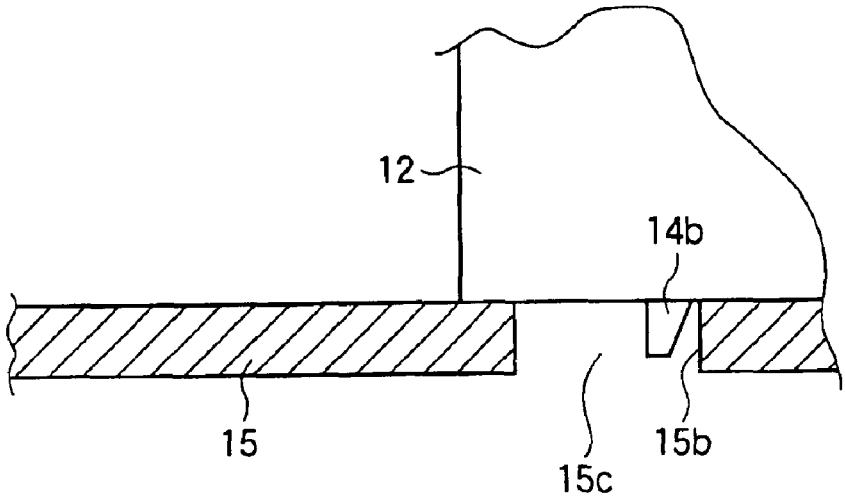
FIG. 24 is an enlarged fragmentary side view of the tail guide when it is locked.

FIG. 24 is an enlarged fragmentary side view of the tail guide 12 when it is locked.

In the third embodiment, as shown in FIG. 22, the sheet-supporting plate 15 is formed with openings 15*b* and 15*b* by which the tail guide 12 is locked at positions where the small size print paper such as A5 size and A6 size are properly guided. If the openings 15*b* and 15*b* are made large, the sheet-supporting plate 15 loses its mechanical strength drastically.

As shown in FIG. 23, when the locking tongues 14*b* of the locking member 14 engage the opening 15*b* and 15*b*, the tail guide 12 is locked. When the tail guide 12 is unlocked, the tail guide 12 is moved in a direction shown by arrow E to a position shown in FIG. 24. An inclined portion 14*c* of the locking tongue 14*b* collides an edge 15*b*, and then climbs on the edge 15*b* to be unlocked. A frequent operation of the tail guide 12 subjects the inclined portion 14*c* to wear.

Figure 25:
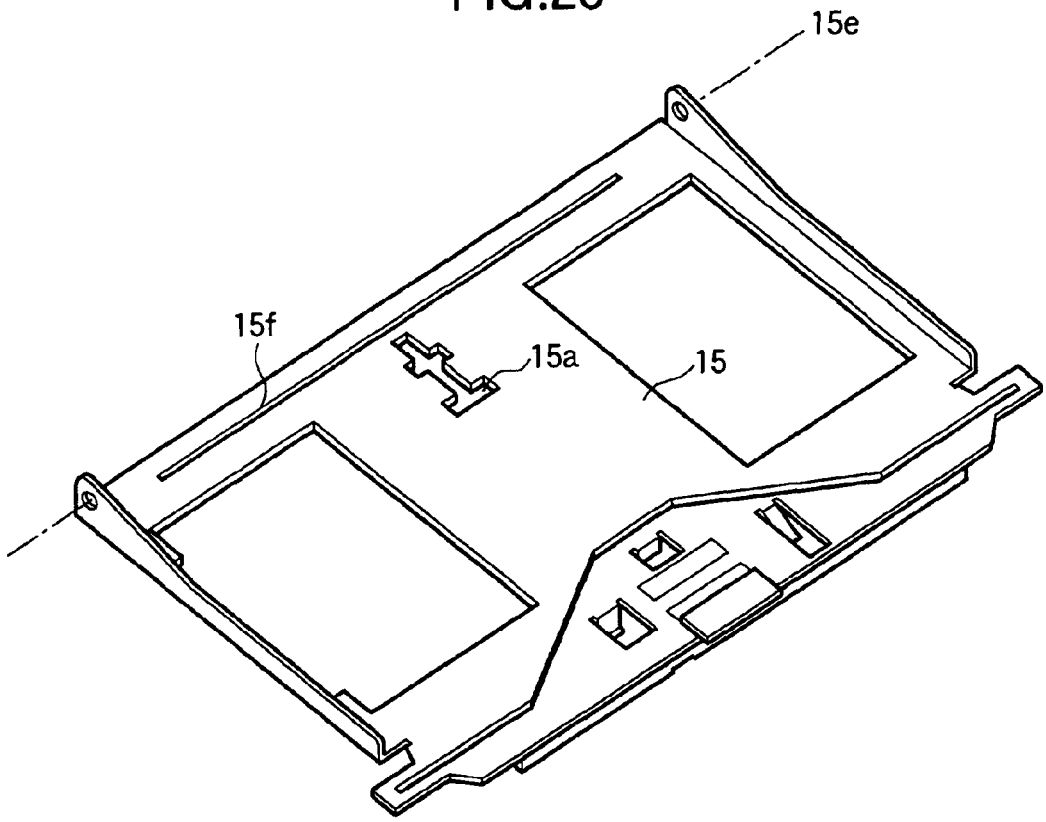
FIG. 25 is a perspective view of the sheet supporting plate according to the fourth embodiment.

FIG. 25 is a perspective view of the sheet supporting plate 15 according to the fourth embodiment.

Figure 26:
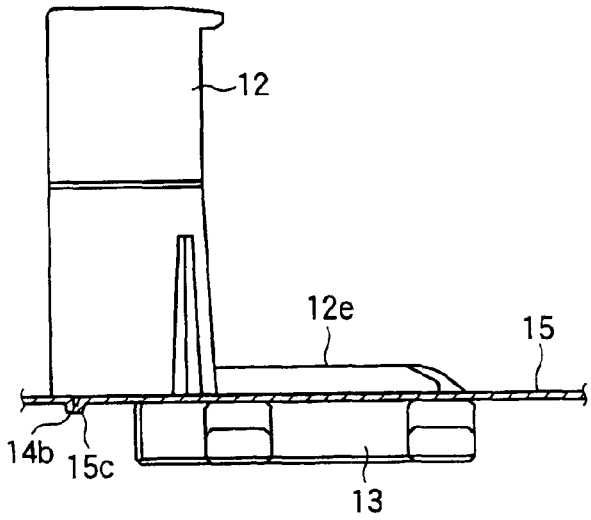
FIG. 26 is a side view of the tail guide when the locking tongues 14*b* are locked.

FIG. 26 is a side view of the tail guide 12 when the locking tongues 14*b* are locked.

Figure 27:
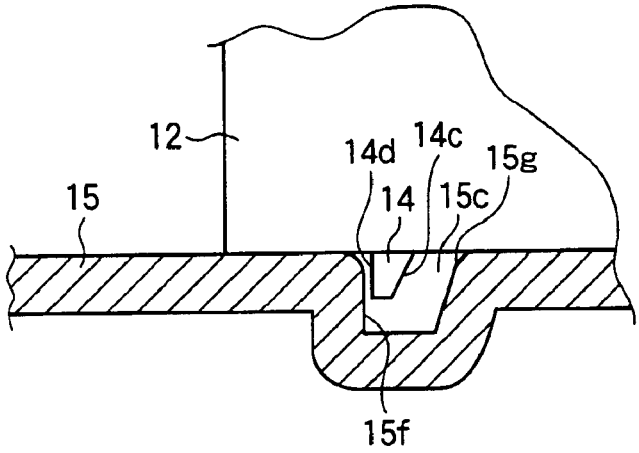
FIG. 27 is a detailed side view of the tail guide when it is locked.

FIG. 27 is a detailed side view of the tail guide 12 when it is locked.

Referring to FIG. 25, the feature of the fourth embodiment is that a recess 15*c* is used in place of the openings 15*b* and 15*b*. The recess 15*c* is formed through a drawing operation and has a trapezoidal cross section as shown in FIG. 27. When the tail guide 12 is placed in position to guide the small size paper such as A5 size and A6 size, the locking tongue 14*b* is received in the recess 15*c* as shown in FIGS. 26 and 27. A vertical surface 14*d* of the locking tongue 14*b* abuts a vertical wall 15*f* of the recess 15*c*, so that the tail guide 12 is locked.

As described above, the recess 15*c* having a trapezoidal cross section minimizes wear of the locking tongue 14*b*. The use of a drawing operation increases the rigidity of the sheet-supporting plate 15, so that the sheet-supporting plate can have a smaller thickness and therefore the manufacturing cost can be saved.

Fifth Embodiment

In the fourth embodiment, if the tail guide 12 is to be reliably locked, the recess 15*c* needs to be formed with a sufficient depth. Deep drawing requires the metal plate to have a sufficient thickness. An inherent problem of deep drawing is that a thick metal plate has a small curvature when it is drawn. This implies that the corner portions of the cross section of the recess 15*c* have small curvatures, so that the distance between the vertical wall 15*c* and an inclined wall 15*g* is rather short. The feature of a fifth embodiment is that openings are formed on both sides of the recess 15*c* formed by a drawing operation.

Figure 28:
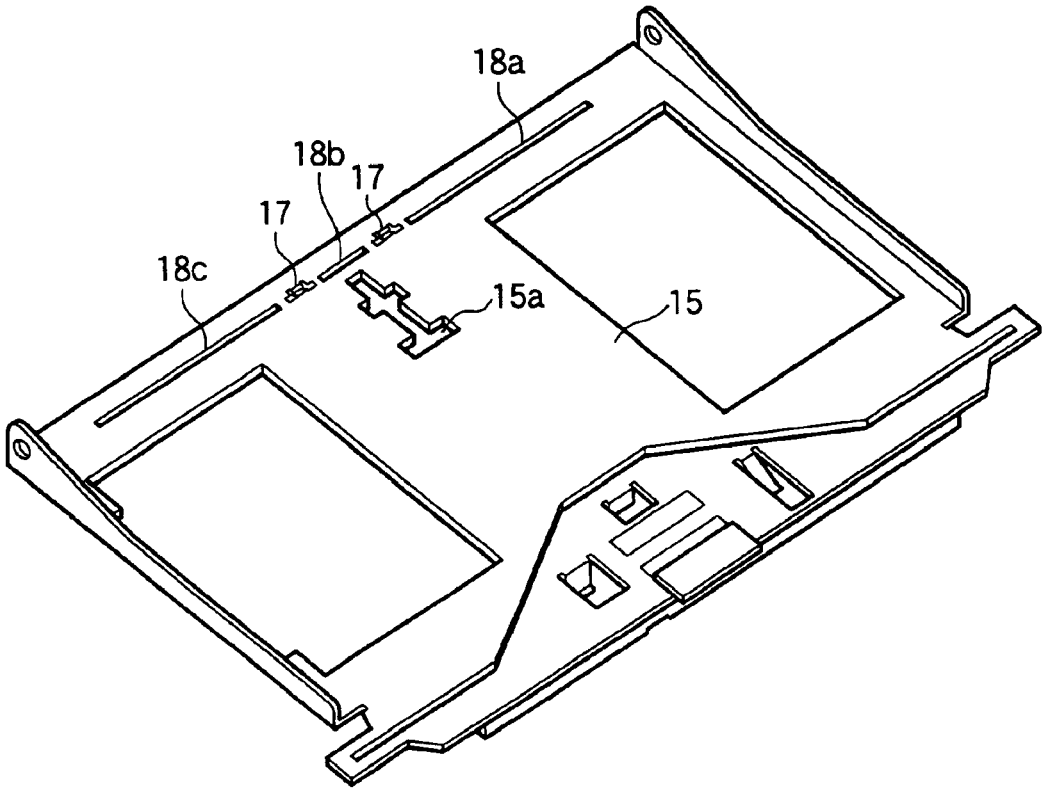
FIG. 28 is a perspective view of the sheet-supporting plate according to a fifth embodiment.

FIG. 28 is a perspective view of the sheet-supporting plate according to the fifth embodiment.

Figure 29:
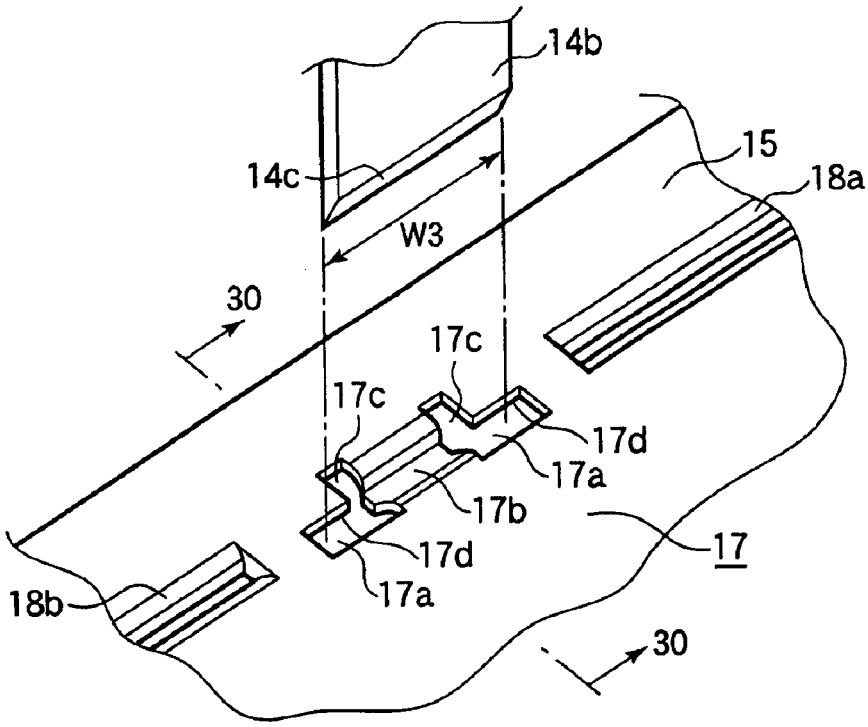
FIG. 29 is a detailed view of the recess.

FIG. 29 is a detailed view of the recess 15*c*.

Figure 30:
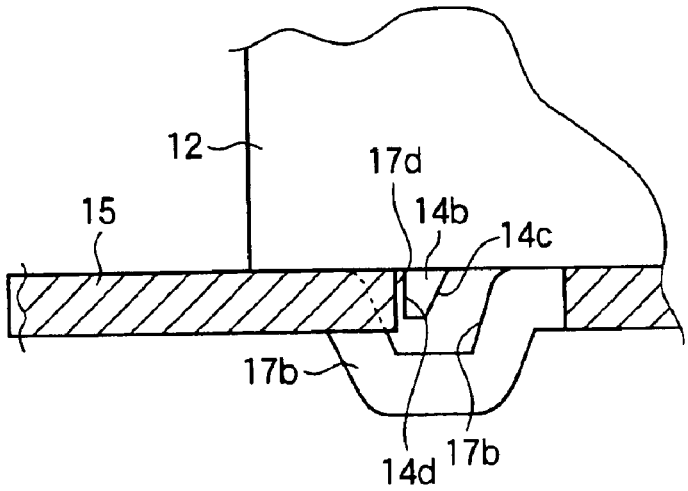
FIG. 30 is a fragmentary cross-sectional view taken along line 30—30 of FIG. 29, illustrating a detailed view of the tail guide when it is locked.
Figure 31:
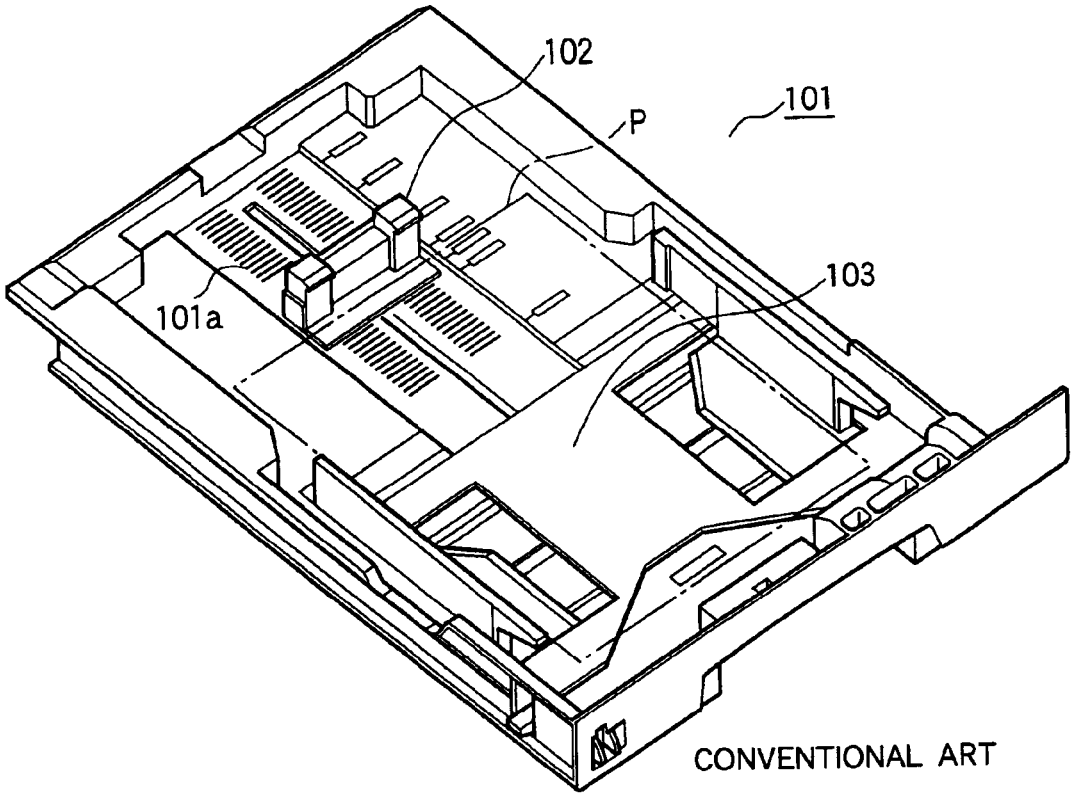
FIG. 31 is a perspective view of a conventional paper-feeding cassette.
Figure 32:
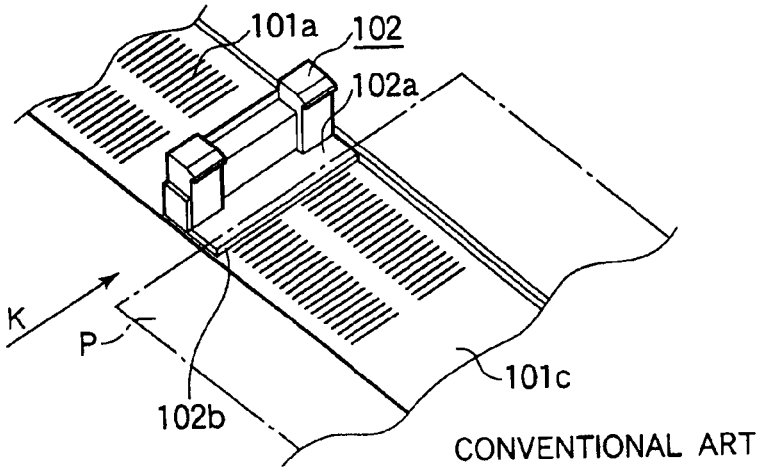
FIG. 32 is a perspective view of the conventional paper cassette when it is loaded with a stack of print paper.
Figure 33:
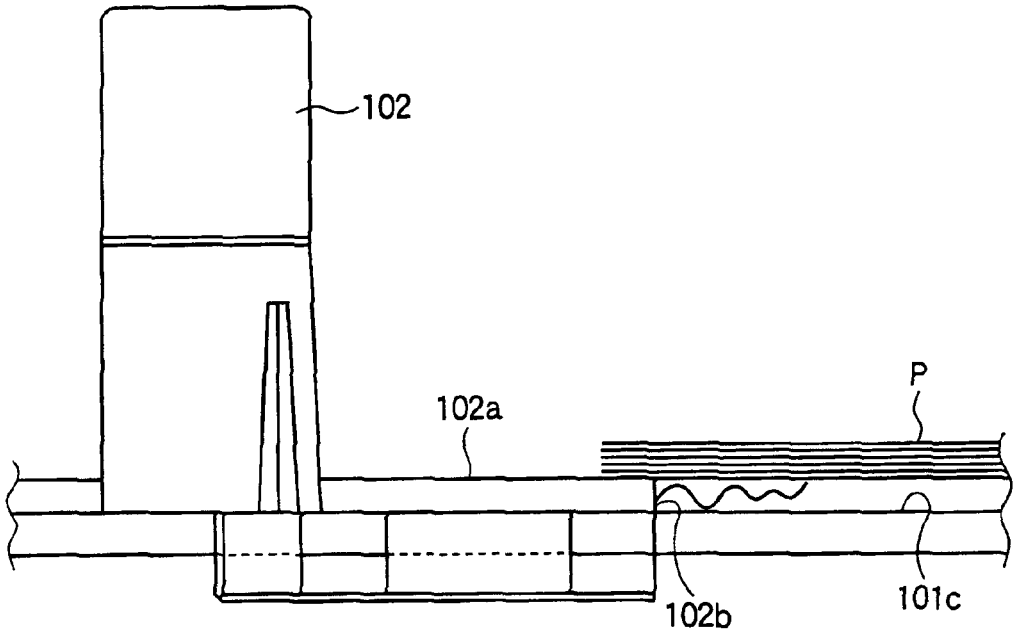
FIG. 33 is a side view as seen in a direction of arrow K of FIG. 32.

FIG. 30 is a fragmentary cross-sectional view taken along line 30—30 of FIG. 29, illustrating a detailed view of the tail guide when it is locked.

Referring to FIG. 28, the sheet supporting plate 15 according to the fifth embodiment is formed with positioning recesses 17 and drawn portions 18*a*–18*c*. When the locking tongue 14*b* of the locking member 14 is received in the positioning recess 17, the tail guide 12 is locked. The positioning recess 17 includes holes 17*a* formed on both sides of the drawn portion 17*b*, a drawn portion 17*b* having a substantially trapezoidal cross section, and cutouts 17*c*. The distance between ends of the holes 17*a* is longer than the length W3 of the locking tongue 14*b* by approximately ¼ of the length of the locking tongue 14*b*.

When the tail guide 12 guides the small size paper such as A5 size and A6 size, the locking tongue 14*b* is received in the holes 17*a* and drawn portion 17*b* as shown in FIG. 29. The vertical surface 14*d* of the locking tongue 14*b* abuts perimeters 17*d* of the holes 17*a*, thereby locking the tail guide 12.

When the tail guide 12 is caused to slide forward (rightward in FIG. 30), the inclined surface 14*c* of the locking tongue 14*b* abuts the inclined wall 17*b* of the drawn portion 17*b* and climbs up the inclined wall 17*b* smoothly. Therefore, the inclined wall 14*c* and inclined surface 17*b* will not damage or scratch each other, allowing smooth dismounting of the tail guide 12.

While the present invention has been described with respect to a tail guide that guides the trailing edge of the print paper. The invention is also applicable to a side guide that guides the side edge of the print paper.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A medium cassette that holds a stack of print medium, comprising:

a medium guide member including a first member and a second member, the second member supporting part of the stack of print medium, said medium guide member being movable in a direction toward the stack of print medium, wherein the second member includes a tapered portion with a tapered edge that extends from a middle portion of the second member leftward and rightward with respect to the direction; and a supporting member including a groove formed therein by which said medium guide member is guided to move to and from the stack of print medium;

wherein when said medium guide member is moved in the direction toward the stack of print medium in the groove to a predetermined position, the first member abuts an end of the stack of print medium and the tapered portion slides under the stack of print medium.

2. The medium cassette according to claim 1, wherein the tapered portion extends further downward below a bottom of the stack of print medium.

3. A medium feeding apparatus that incorporates the medium cassette according to claim 1.

4. The medium cassette according to claim 1, further comprising a medium-supporting member on which the stack of print medium is placed, wherein medium guide member can be mounted on the medium-supporting member.

5. The medium cassette according to claim 4, wherein said medium guide member includes a locking member and the medium-supporting member includes a recess formed therein by a drawing operation;

wherein maid medium guide member is locked at a predetermined position when the locking member is received in the recess.

6. A medium cassette that holds a stack of print medium, comprising:

a medium guide member including a first member and a second member, the second member including a tapered forward end portion; and a supporting member including a groove formed therein by which said medium guide member is guided to move to and from the stack of print medium;

wherein when said medium guide member is moved in a direction toward the stack of print medium in the groove to a predetermined position, the first member abuts an end of the stack of print medium and the tapered forward end portion slides under the stack of print medium;

wherein the second member has an edge that extends from a middle portion of the second member leftward and rightward with respect to the direction;

wherein the edge becomes further away from the stack of print medium than the middle portion with increasing distance from the middle portion.

7. The medium cassette according claim 6, wherein the edge extends from the middle portion to describe either a curved line or a straight line.

8. A medium feeding apparatus that incorporates the medium cassette according to claim 7.

9. A medium cassette that holds a stack of print medium, comprising:

a medium guide member including a first member and a second member, the second member including a tapered forward end portion; and a supporting member including a groove formed therein by which said medium guide member is guided to move to and from the stack of print medium;

wherein when said medium guide member is moved in a direction toward the stack of print medium in the groove to a predetermined position, the first member abuts an end of the stack of print medium and the tapered forward end portion slides under the stack of print medium;

wherein said medium guide member further includes a first projection that extends from a bottom surface of the second member through the groove;

wherein the first projection includes second projections that project substantially leftward and rightward with respect to the direction so that the supporting member is sandwiched between the bottom surface of the second member and the second projections.

10. The medium cassette according to claim 9, wherein the second projections include a first set of the second projections that extends over a first distance and a second set of the second projections that extends over a second distance.

11. The medium cassette according to claim 10, wherein each of the second projections includes a plurality of stepped portions;

wherein the supporting member can be held in a sandwiched relation between the bottom surface of the second member and a corresponding one of the plurality of stepped portions.

12. A medium feeding apparatus that incorporates the medium cassette according to claim 11.

13. A medium feeding apparatus that incorporates the medium cassette according to claim 10.

14. A medium cassette that holds a stack of print medium, comprising:

a medium guide member including a first member and a second member, the second member including a tapered forward end portion; and a supporting member includes a groove formed therein by which said medium guide member is guided to move to and from the stack of print medium;

wherein when said medium guide member is moved in a direction toward the stack of print medium in the groove to a predetermined position, the first member abuts an end of the stack of print medium and the tapered forward end portion slides under the stack of print medium;

further comprising a medium-supporting member on which the stack of print medium is placed, wherein said medium guide member can be mounted on the medium-supporting member;

wherein said medium guide member includes a locking member and the medium-supporting member has a recess formed therein by a drawing operation;

wherein said medium guide member is locked at a predetermined position when the locking member is received in the recess; and wherein the medium-supporting member has an opening beside the recess.

15. A medium feeding apparatus that incorporates the medium cassette according to claim 14.

16. A medium cassette that holds a stack of print medium therein, comprising:

a supporting member having a groove formed therein;

a medium guide member including a first member and a second member that slides under the stack of print medium, said medium guide member being detachably mounted to said supporting member and guided in the groove to and from the stack of print medium; and a medium-supporting member on which the stack of print medium is placed, said medium-supporting member pushing up the print medium and having an opening formed therein through which said medium guide member can be mounted;

wherein the medium guide member further includes a first projection that extends from a bottom surface of the second member through the groove;

wherein the medium guide member includes second projections that project substantially leftward and rightward with respect to the direction so that the supporting member is sandwiched between the bottom surface of the second member and the second projections.

17. The medium cassette according to claim 16, wherein each of the second projections includes a plurality of stepped portions so that the supporting member can be held in a sandwiched relation between the bottom surface of the second member and a corresponding one of the plurality of stepped portions.

18. The medium cassette according to claim 16, wherein said medium guide member includes a locking member and the medium-supporting member includes a recess formed therein by a drawing operation, wherein said medium guide member is locked at a predetermined position when the locking member is received in the recess.

19. A medium feeding apparatus that incorporates the medium cassette according to claim 18.

20. The medium cassette according to claim 18, wherein the medium-supporting member includes an opening beside the recess.

21. A medium feeding apparatus that incorporates the medium cassette according to claim 20.

22. A medium feeding apparatus that incorporates the medium cassette according to claim 16.

* * * * *